United States Patent [19]

Schuh et al.

[11] Patent Number: 5,065,887

[45] Date of Patent: Nov. 19, 1991

[54] CONTAINER WITH HINGED COVER

[75] Inventors: Robert R. Schuh, Kaukauna, Wis.; Nancy E. Terrell, Stamford, Conn.; Walter J. Kreiseder, Barrington; Allen J. Vogel, Long Grove, both of Ill.

[73] Assignee: Scott Paper Company, Philadelphia, Pa.

[21] Appl. No.: 481,589

[22] Filed: Feb. 20, 1990

[51] Int. Cl.[5] ..... B65D 43/14

[52] U.S. Cl. ..... 220/338; 206/205

[58] Field of Search ..... 220/334, 335, 337, 338

[56] References Cited

U.S. PATENT DOCUMENTS

| | | | |
|---|---|---|---|
| 2,460,488 | 2/1949 | Brunetti | 220/338 |
| 2,765,949 | 10/1956 | Hillman | 220/338 |
| 2,960,254 | 11/1960 | Kiba | 220/338 |
| 3,015,418 | 1/1962 | Hornston | 222/108 |
| 3,045,860 | 7/1962 | Harvey | 220/338 |
| 3,438,535 | 4/1969 | Tisserand et al. | |
| 3,456,913 | 7/1969 | Lutz | |
| 3,754,639 | 8/1973 | Gellert | |
| 3,841,466 | 10/1974 | Hoffman et al. | 206/205 |
| 3,860,141 | 1/1975 | Hawk | 220/338 |
| 3,968,921 | 7/1976 | Jewell | 220/337 X |
| 4,005,800 | 2/1977 | Schurman | 220/337 |
| 4,216,862 | 8/1980 | Daener | 220/337 X |
| 4,220,253 | 9/1980 | Thomas et al. | 220/338 |
| 4,349,120 | 9/1982 | DiNardo | 220/337 |
| 4,399,928 | 8/1983 | Klingler | 220/335 |
| 4,428,497 | 1/1984 | Julius et al. | 220/339 |
| 4,742,928 | 5/1988 | Braun | 215/235 |
| 4,925,059 | 5/1990 | Harvey et al. | 220/335 |
| 4,971,220 | 11/1990 | Kaufman et al. | 220/335 |

*Primary Examiner*—Stephen Marcus
*Assistant Examiner*—Nora Stucker
*Attorney, Agent, or Firm*—Mark G. Bocchetti; John W. Kane, Jr.

[57] ABSTRACT

A container including a container body, at least one socket member connected to the container body and having spaced generally opposed socket walls defining a passageway, and a cover attachable to the container body, the cover including at least one pivot member which enters the passageway when the cover is attached to engage a socket receptacle.

18 Claims, 7 Drawing Sheets

FIGURE 6
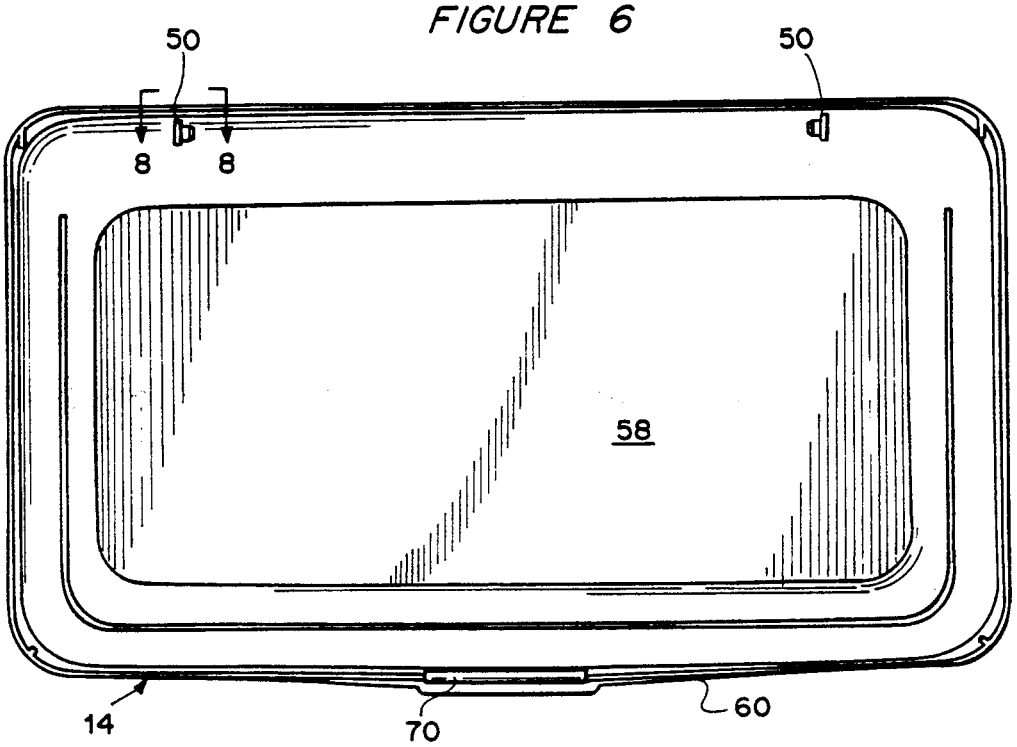
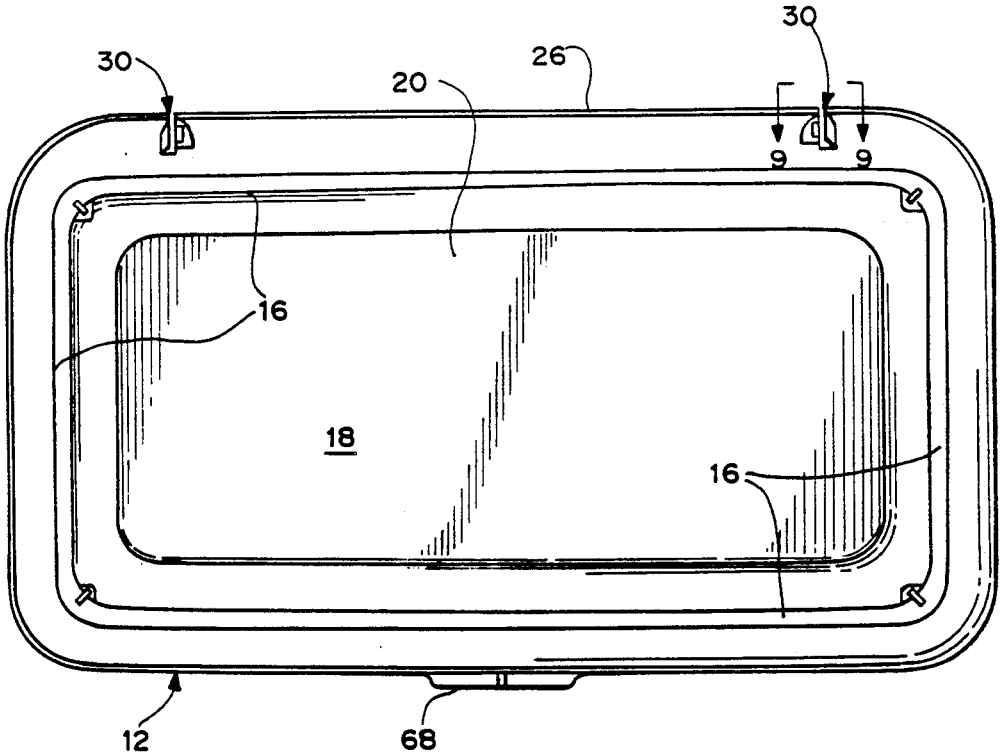
FIGURE 7

CONTAINER WITH HINGED COVER

TECHNICAL FIELD

This invention relates to a container including a container body and a cover hingedly attachable to the container body. The hinge arrangement not only facilitates assembly of the container body and cover but also adds to the convenience and effectiveness of the container during use. The container incorporates several features which render it particularly useful for the storage of moistened wash cloths or similar products to be kept moist until removed by the consumer.

BACKGROUND ART

A wide variety of containers are known in the prior art which include a container body and a cover hingedly connected to the container body. Many prior art containers are for the retention of products of various types during shipment and storage. Some containers also function to contain therein a supply of items of various types which are gradually depleted over a period of time by the consumer. Some items, for example pre-moistened wipes or wash cloths, require a container in which the cover will form an essentially moisture-tight seal with the container body when closed, even after repeated opening of the container during depletion of the articles over a period of time.

Often, the hinge arrangements utilized in the prior art containers of this latter type actually interfere with the proper moisture-tight closure of the containers. Furthermore, many prior art hinge constructions are of the so-called "living hinge" type; that is, the hinges are integrally formed with both the container body and the cover. Repeated use can cause hinges of this type to break. In addition, living hinge constructions may cause inadvertent closure of the cover when the user wishes it to remain open. Retrieval of the container's contents can be a two hand project when the consumer only has one free.

There are, of course, prior art containers in existence incorporating hinge constructions other than the integral or living hinge. Many incorporate a separate container body and cover, with the cover being retained on the container body by cooperating hinge elements on the cover and container body. For example, hinges comprising a socket member on either the container body or the cover have been employed which pivotally receive a projection on the other container component to complete the hinge. Such hinge constructions are often difficult to assemble, requiring either highly specialized equipment or relatively intensive labor. Also, extremely tight manufacturing tolerances often must be maintained, especially when the container is formed of molded plastic material, to ensure proper fit and operation of the hinge components both during assembly and thereafter.

DISCLOSURE OF THE INVENTION

The container of the present invention addresses and solves the problems found in the prior art containers recited above.

In particular, the present container incorporates a hinge construction which allows for the ready assembly of a cover to a container body without requiring that close tolerances be maintained either during the assembly process or during manufacture of the container components.

The hinge arrangement employed in the container of the present invention cooperates with the cover and container body to maintain the cover open when desired by the user without the possibility that the cover will inadvertently close as is the case with living hinge constructions.

Another advantage of the arrangement disclosed herein is the fact that the pivot structure of the present invention accurately positions the cover relative to the container body and allows the cover to close firmly and form a seal with the container body when the cover is moved intentionally to a closed position by the consumer. Integral or living hinges utilized in the prior art do not always allow this since the pivot point defined by such hinges can actually change over time after repeated use. Accurate pivot and proper closure are especially important when the container is being utilized to retain therein products, such as moistened wipes or wash cloths, which are to be isolated from the ambient atmosphere when the container is closed.

Finally, the hinge arrangement of the present invention allows the user to completely detach the cover from the container body if desired.

More specifically, the container constructed in accordance with the teachings of the present invention includes a container body having a plurality of interconnected side walls and a bottom wall, the container body walls defining an interior.

At least one socket member is connected to the container body, the socket member including spaced, generally opposed first and second socket walls defining a passageway, said first socket wall defining a receptacle and the second socket wall defining a contact surface.

A cover is attachable to the container body, the cover including a top cover panel and at least one pivot member operatively associated with the top cover panel. The pivot member includes a support arm and a projection projecting from the support arm. The support arm is engageable with the contact surface and the projection positionable in the receptacle when the support arm is in the passageway and located between the first and second socket walls.

The container also includes a lip element extending outwardly from at least one of the container body side walls. The socket member is integrally formed with the lip element and positioned adjacent to and external of one of the container body side walls.

The lip element includes an outwardly extending lip segment and a downwardly extending lip segment integrally attached to the outwardly extending lip segment. The spaced, generally opposed socket walls extend from and are integral with the lip element and the passageway is in communication with and leads from an opening formed in the lip element. The spaced, generally opposed socket walls converge whereby the passageway narrows as it progresses from the opening.

Other features, advantages and objects of the present invention will become apparent with reference to the following detailed description and accompanying drawings.

BRIEF DESCRIPTION OF THE DRAWINGS

FIG. 6 is an enlarged bottom view of the container cover;

FIG. 7 is an enlarged top view of the container body;

DISCLOSURE OF THE INVENTION

Figure 1:
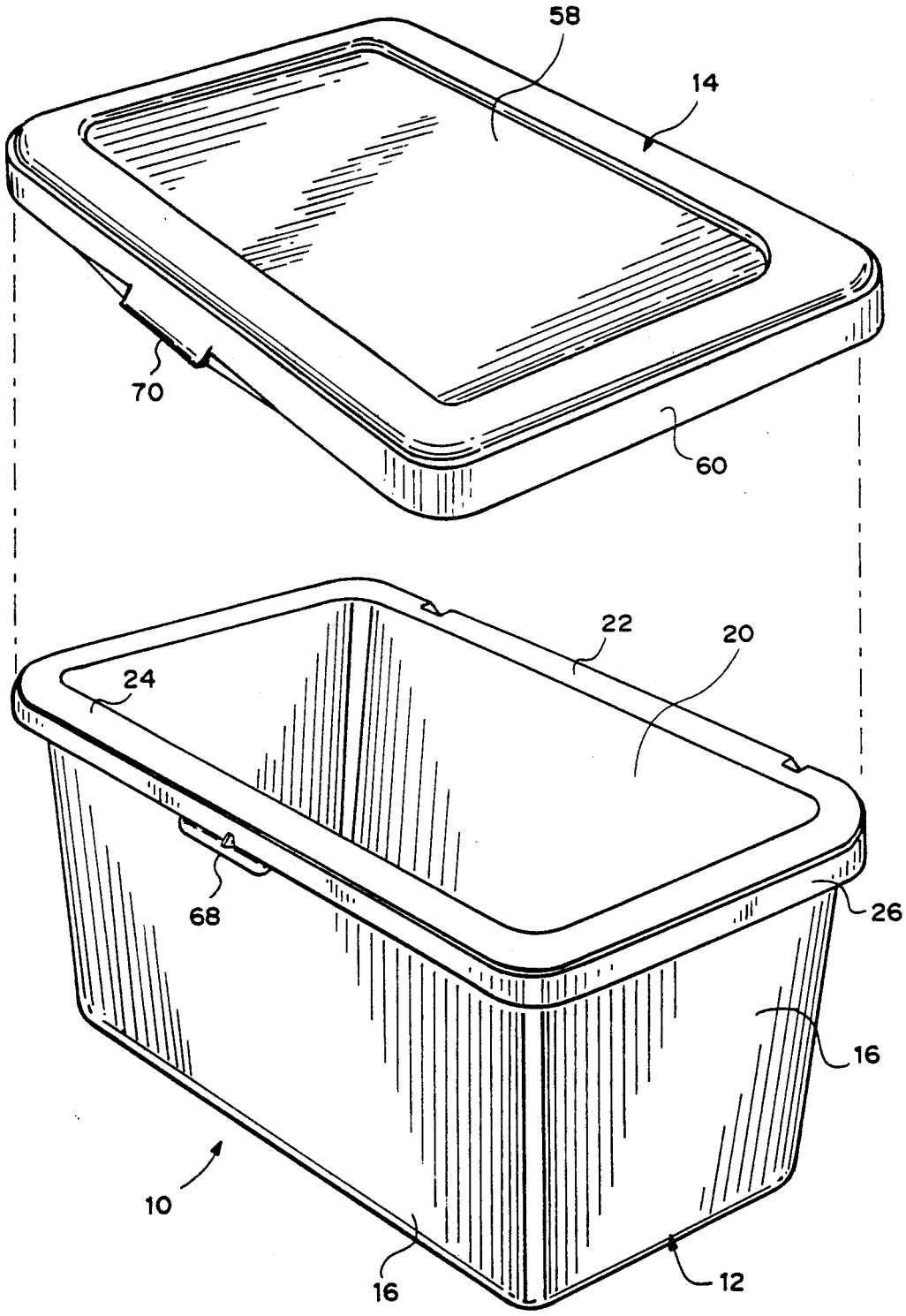
FIG. 1 is a perspective, exploded view illustrating the cover of the container of the present invention prior to its assembly with the container body.

Referring now to FIGS. 1-12, inclusive, a preferred embodiment of a container constructed in accordance with the teachings of the present invention is illustrated. The container is generally designated by reference numeral 10 and includes a container body 12 and a cover 14 attachable to the container body in a manner to be described below.

Container 10 is preferably constructed of molded plastic material such as a copolymer plastic material. The particular illustrated configuration of the container 10 is highly suitable for the retention of pre-moistened wipes or wash cloths; however, it is to be understood that the teachings of the present invention may be utilized in containers employed to package a wide variety of products and materials.

Container body 12 includes a plurality of interconnected side walls 16 and a bottom wall 18. Walls 16 and 18 define an interior 20.

The container body additionally includes a lip element 22. The lip element includes an outwardly extending lip segment 24 and a downwardly extending lip segment 26. Lip element 22 extends about the periphery of interior 22 and is integral with side walls 16. Lip segment 26 is, as shown in the drawings, spaced from side walls 16. Although lip segment 26 is relatively stiff it has a degree of flexibility, especially at the lower edge thereof. A plurality of spaced ribs 28 project outwardly from the upper extent of side walls 16 to downwardly extending lip segment 26 in the vicinity of outwardly extending lip segment 24, the ribs being integral with the walls and both lip segments. This contributes to the structural stability of the lip element, and especially the lip segment 24 thereof.

In addition to container body 12 and cover 14, the container 10 includes socket means. In particular, the socket means comprises two spaced socket members 30 integrally connected to container body 12. Each socket member 30 includes spaced, generally opposed first and second socket walls 32, 34, respectively, defining a passageway 36. First socket wall 32 defines a receptacle in the form of an aperture 42. Second socket wall 34 defines a contact surface 44.

Each socket member 30 is integrally formed with the lip element 22 and positioned adjacent to and external of one of the container body side walls 16. The passageway 36 defined by the first and second socket walls is in communication with and leads from an opening 48 formed in the lip element.

Figure 10:
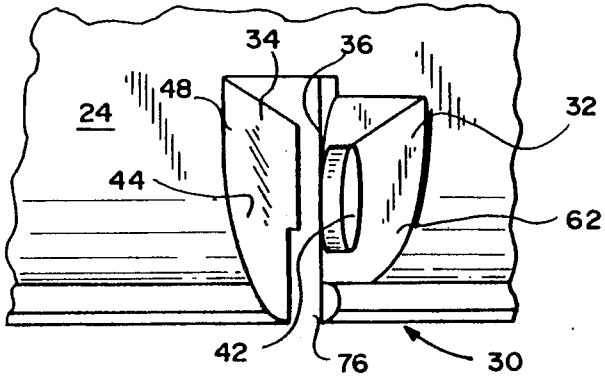
FIG. 10 is an enlarged fragmentary view taken in the direction of line 10—10 in FIG. 9 and illustrating details of the container socket member.
Figure 11:
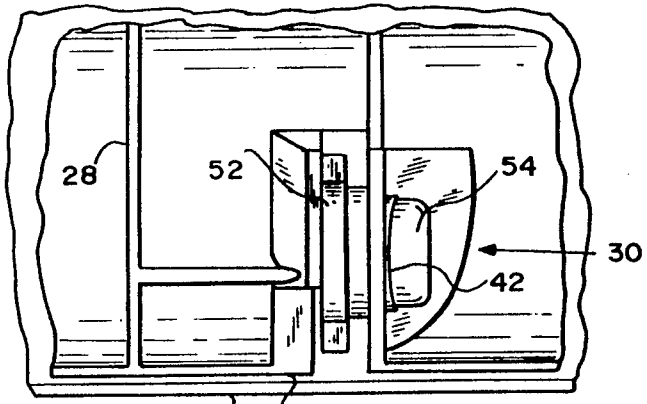
FIG. 11 is an enlarged, fragmentary view taken in the direction of line 11—11 in FIG. 5, but illustrating the socket member and cover pivot member in assembled condition.
Figure 8:
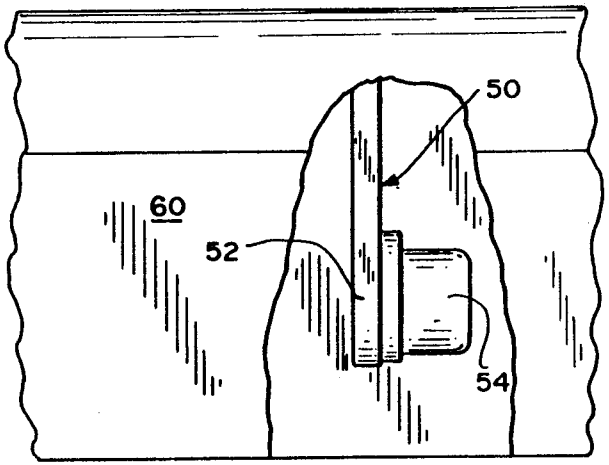
FIG. 8 is an enlarged, fragmentary, side view of a preselected portion of the container cover taken along line 8—8 in FIG. 6 with a segment broken away to illustrate details of the cover pivot member.
Figure 9:
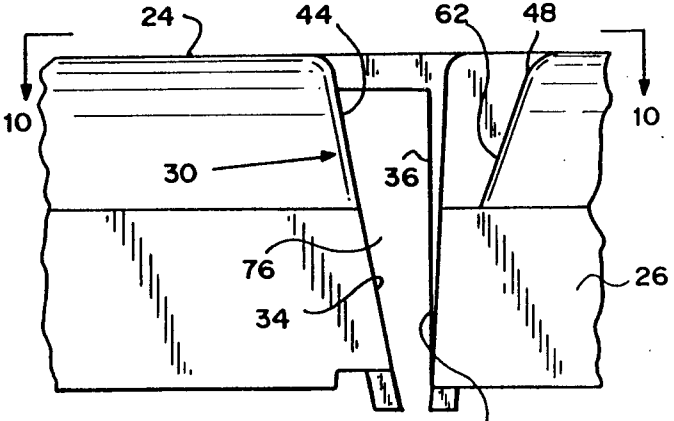
FIG. 9 is an enlarged, fragmentary, side view of a preselected portion of the container body taken along line 9—9 in FIG. 7 and illustrating details of the socket member connected to the container body.

As shown in FIGS. 9 and 10, the spaced, generally opposed socket walls 32, 34 converge so that the passageway 36 narrows as it progresses from opening 48. Although FIGS. 9 and 10 illustrate only one of the socket members 30, it is to be understood that both socket members 30 are of the same construction but with the positions of the first and second socket walls reversed.

Each socket member 30 is adapted to cooperate with a pivot member comprising part of the cover 14. In particular, the two pivot members employed in the construction of cover 14 are identified by reference numeral 50. Pivot members 50 are spaced apart a distance generally corresponding to the distance between socket members 30. Each pivot member 50 includes a support arm 52 and a projection 54 projecting from the support arm. Each projection 54 is in the form of a boss having a circular cross section which approximates the cross section of aperture 42.

Cover 14 also includes a top cover panel which is of generally planar construction. The support arms 52 project outwardly from the top cover panel 58 at generally right angles thereto. The pivot members 50 are integrally formed with the cover during molding thereof.

Cover 14 additionally includes a peripheral skirt 60 extending about the top cover panel for placement adjacent to and external of the container body lip element 22 when the cover is disposed over interior 20. Pivot members 50 are each attached to the top cover panel at a location spaced inwardly of the peripheral skirt 60. The cross-sectional configuration of skirt 60 closely conforms to that of the combined outer surfaces of lip segments 24 and 26 so that a generally air-tight fit is maintained therebetween after the cove has been attached to the container body and is in closed position with respect thereto.

Application of the cover 14 to container body 12 is a very simple and straightforward matter. At the same time the cover is placed over the container body and pressed into engagement therewith the pivot members 50 will be operatively connected to socket members 30. A slight downward pressure accomplishes this. Furthermore, the pivot members 50 need not be precisely positioned with regard to the socket members for attachment to be made. Thus, during the manufacturing process in which the container is assembled, precise relative container body and cover locations need not be maintained; nor is it necessary to maintain ultra precise tolerances when molding the container body and cover.

The cover is applied to the container body by carrying out the steps which will now be described. First, the cover 14 is positioned over the container body 12 as shown in FIG. 1. These two components are then brought into engagement. As the container body and cover are brought into close proximity, the pivot members 50 will enter openings 48 formed in lip element 22. As each pivot member 50 moves downwardly within its associated passageway 36 the pivot member will first engage either the first or second socket wall defining the passageway. The socket walls 32, 34 of course converge as previously described so that projection 54 of the pivot member will be gradually positioned relative to aperture 42 so that it can enter the aperture. Referring now to FIG. 9, it will be noted that first socket wall 32 includes a slanted guide surface 62 leading from opening 48. Thus, if pivot member 50 is offset to the right as viewed in FIG. 9 when initially applied, the projection 54 will engage the guide surface 62 and the pivot member (along with the rest of the cover) will necessarily move to the left as it continues down the passageway.

If the pivot member and its cover are offset or out of alignment to the left as viewed in FIG. 9, support arm 52 will engage socket wall 34 and move the pivot member and cover to the right.

In any event, at some point during downward movement of pivot member 50, it will engage both walls 32 and 34 because the passageway has narrowed to a width less than the combined width of support arm 52 and projection 54. This will be before projection 54 comes into registry with aperture 42. By continuing to exert downward pressure on the cover one or both of the walls 32, 34 will be deformed and will move away from one another while exerting a continuous bias against the pivot member 50.

When the projection 54 comes into registry with aperture 42 such bias will cause the projection 54 to snap into the aperture and be seated therein. After seating occurs socket wall 34 will continue to exert a bias against the support arm 52 of pivot member 50 and thus lock the pivot member in operative relationship with the associated socket member 30. Also, the skirt 60 of the cover will be in continuous engagement with the lip element 22 of the container body to maintain a generally fluid-tight seal therebetween.

The interior surface of the top cover panel has a ridge element 66 projecting therefrom, said ridge element being positioned against the tops of side walls 16 of the container body when the cover is closed to assist in formation of the desired seal.

To help maintain the cove in closed position it is preferred that a lock element 68 extend from the lip element 2 on the side of the container body opposed to the side incorporating the pivot structure. The lock element 68 is adapted to be resiliently retained within a slot formed in a manually graspable element 70 formed on cover skirt 60. Since the skirt 60 is deformable, the user can cause dislodgement of the lock element simply by pulling upwardly on manually graspable element 70.

Figure 3:
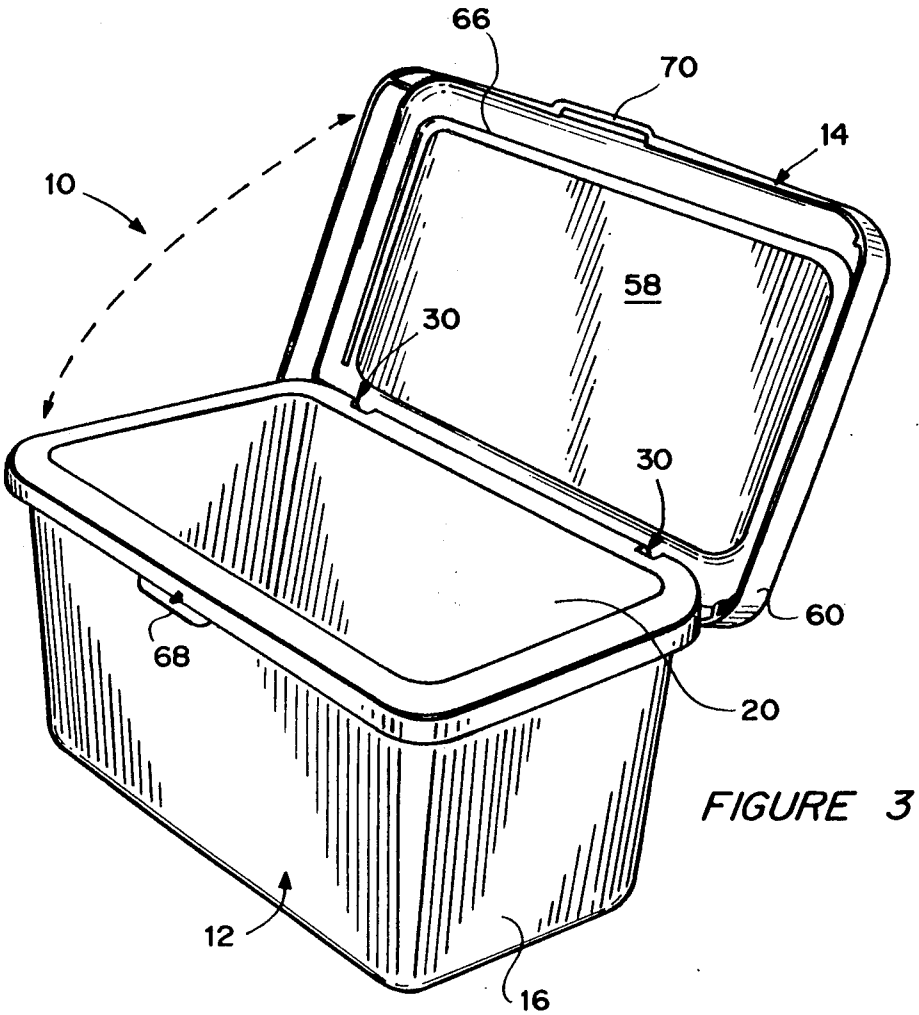
FIG. 3 is a view similar to FIG. 2 but showing the cover in open position.
Figure 2:
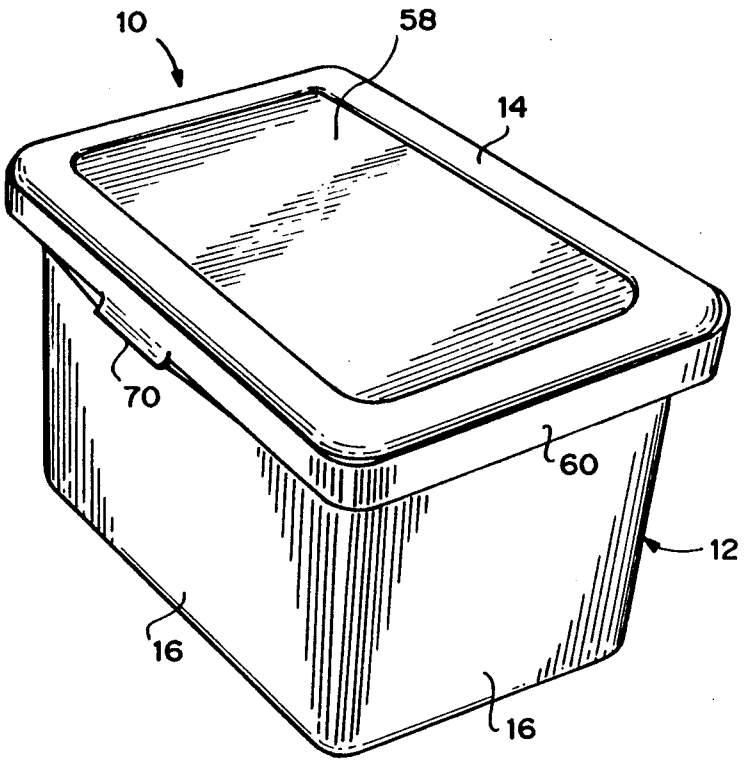
FIG. 2 is a perspective view of the container of FIG. 1 with the container body and cover in assembled condition and the cover closed.
Figure 4:
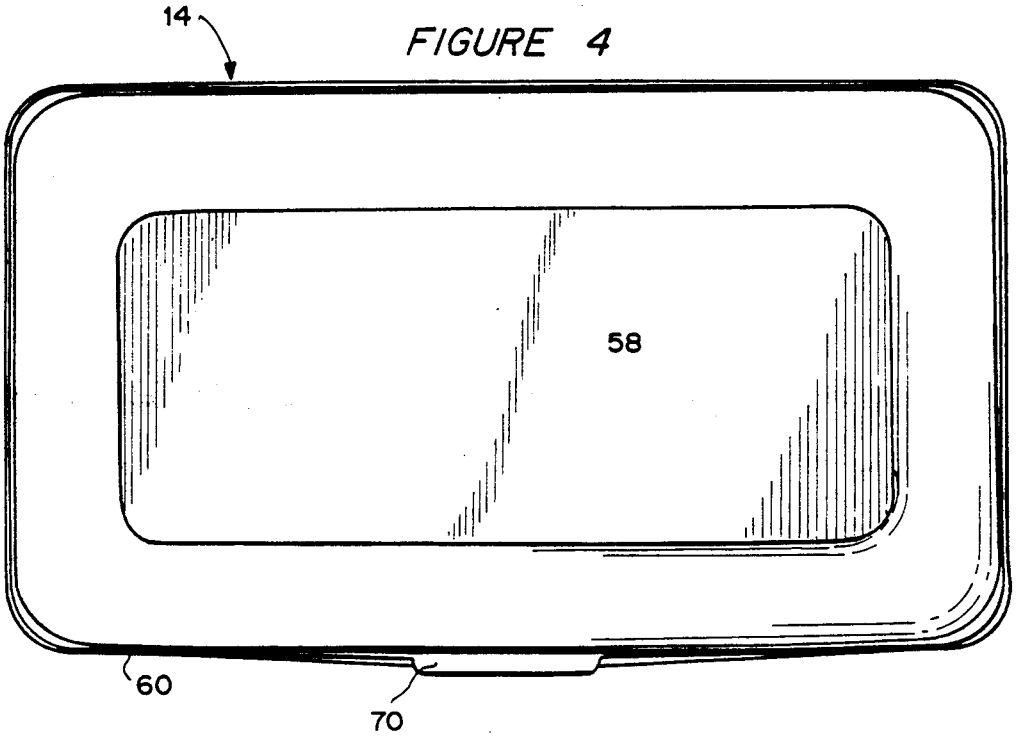
FIG. 4 is an enlarged top plan view of the container cover.
Figure 5:
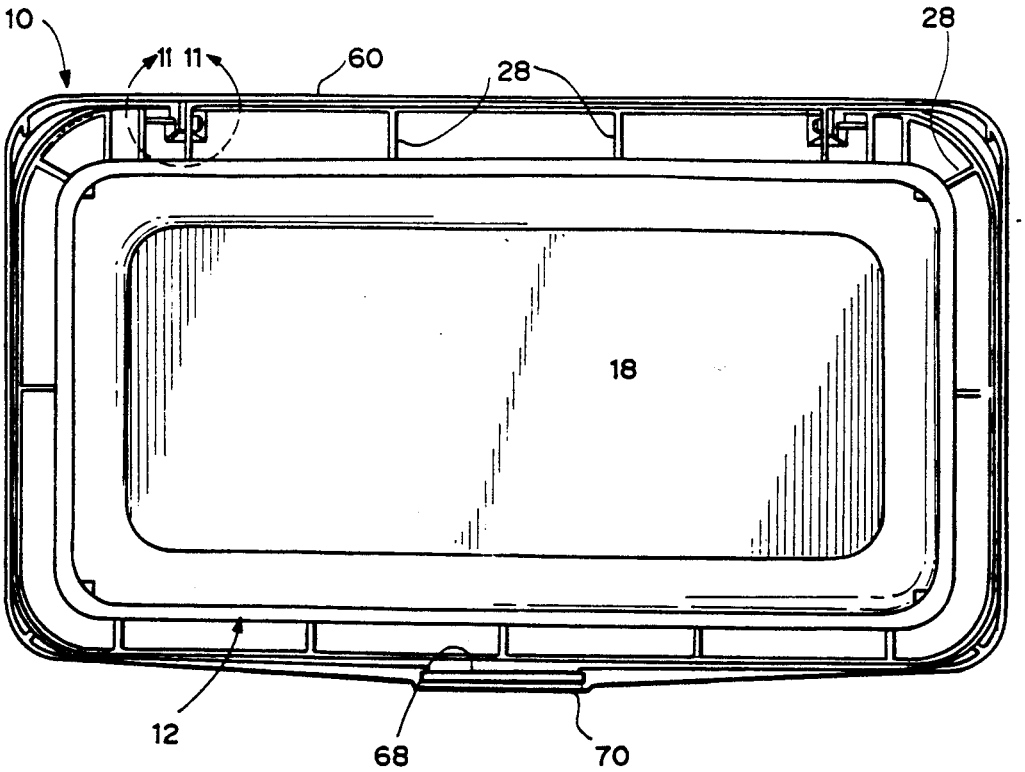
FIG. 5 is an enlarged bottom view of the container, with the cover attached to the container body and in closed position.

When the consumer opens the cover 14 to the position shown in FIG. 3 the cover will remain open. This is because the cover in such position is in an over-center condition; that is, the cover slants back away from the vertical and the force of gravity continuously urges the cover in the direction of the arrow shown in FIG. 3.

Figure 14:
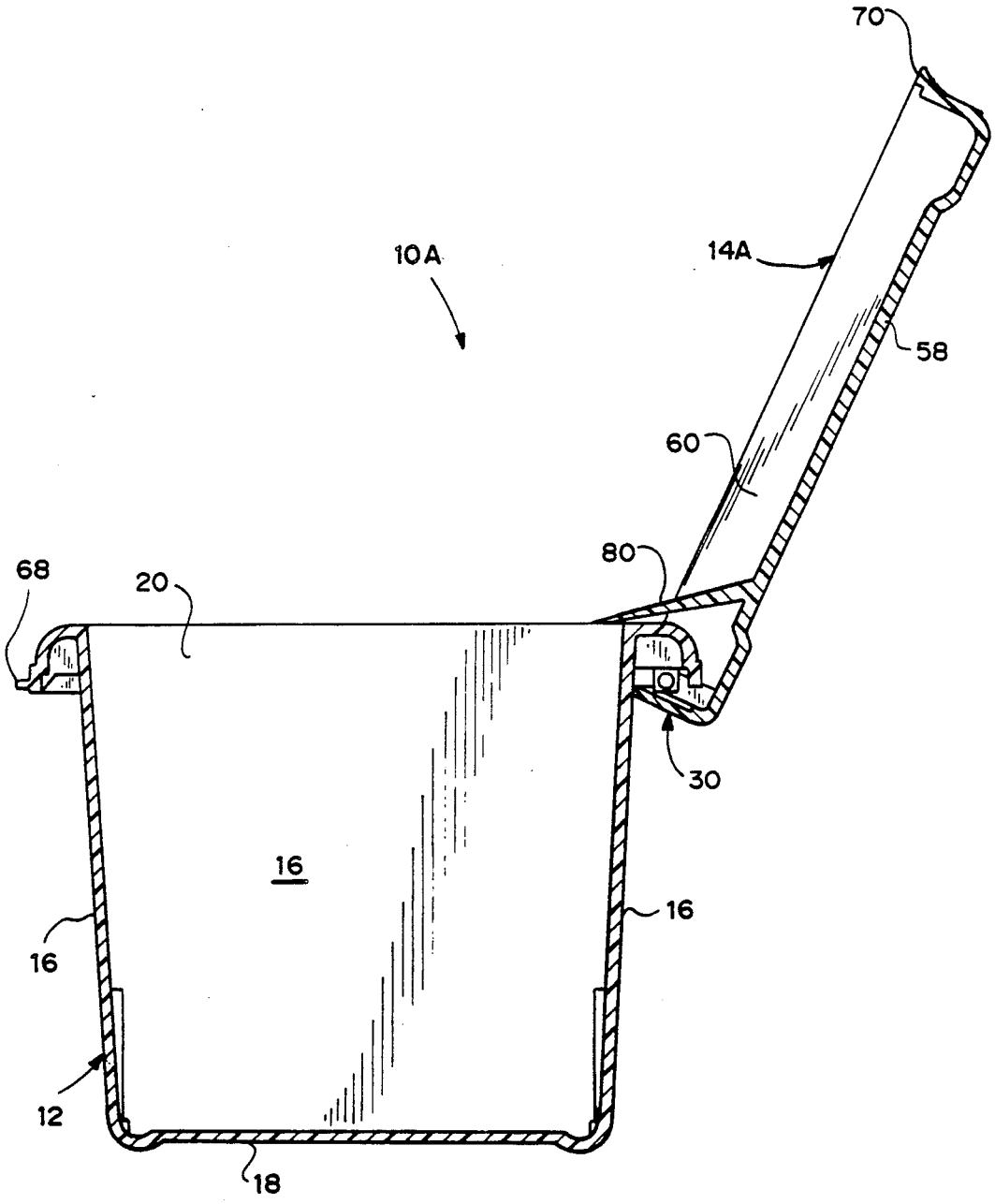
FIG. 14 is an enlarged cross-sectional view taken along the line 14—14 in FIG. 13.

The cover is free to move to such position because at each socket member 30, a slit 76 is formed in downwardly extending lip segment 26, said slit being in communication with the passageway 36. When the cover 14 is pivoted to an open position the support arm 52 of the pivot member is thus free to move without hindrance. Once, however, the free edge of the peripheral skirt engages the container body further pivoting of the cover must by necessity cease. FIG. 14, which relates to an alternative embodiment of the invention to be described below, may be referred to for a more detailed showing of this feature.

In the illustrated preferred embodiment of the invention shown in FIGS. 1–12, the first socket wall 32 is relatively thin in the vicinity of aperture 42. This enables the consumer to completely remove the cover from the container body if desired. This can be done by exerting a backward and downward directed force on the open cover to a sufficient degree that the first socket walls of the socket members will be broken by projection 54. Even after this has occurred, the cover may be reapplied to the container body in the manner previously described to maintain a generally fluid-tight seal to protect the package contents. The hinge structure will still have sufficient integrity to enable the lid to pivot and cooperate with the container body as before to provide the originally intended benefits. This frangibility feature will, of course, not exist if the manufacturer chooses to employ a thick, rather than thin, first socket wall.

Figure 13:
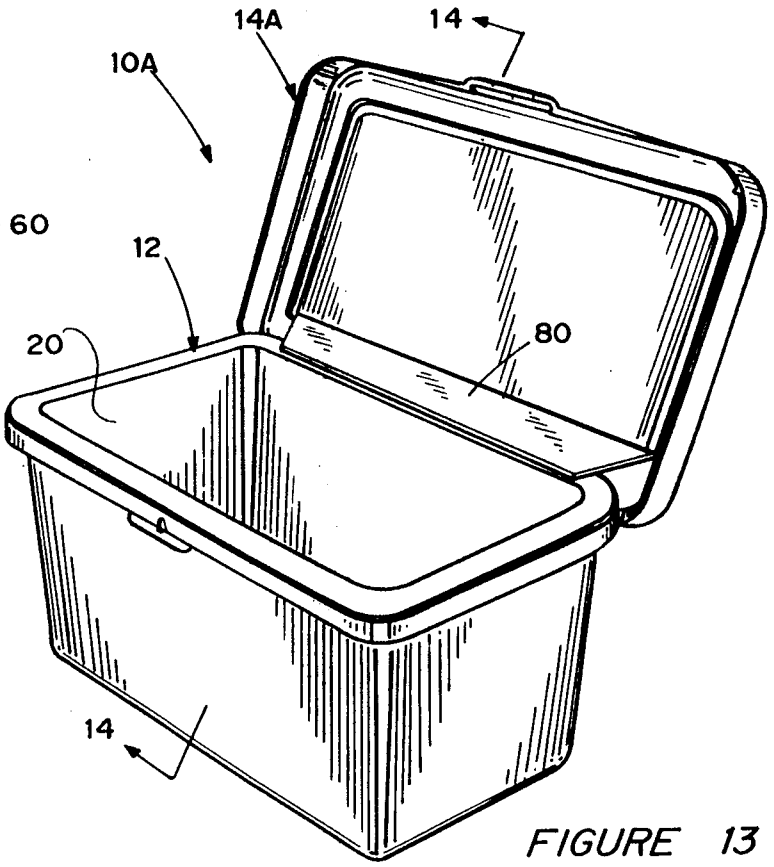
FIG. 13 is a view similar to FIG. 3 but illustrating an alternative embodiment of the container.
Figure 12:
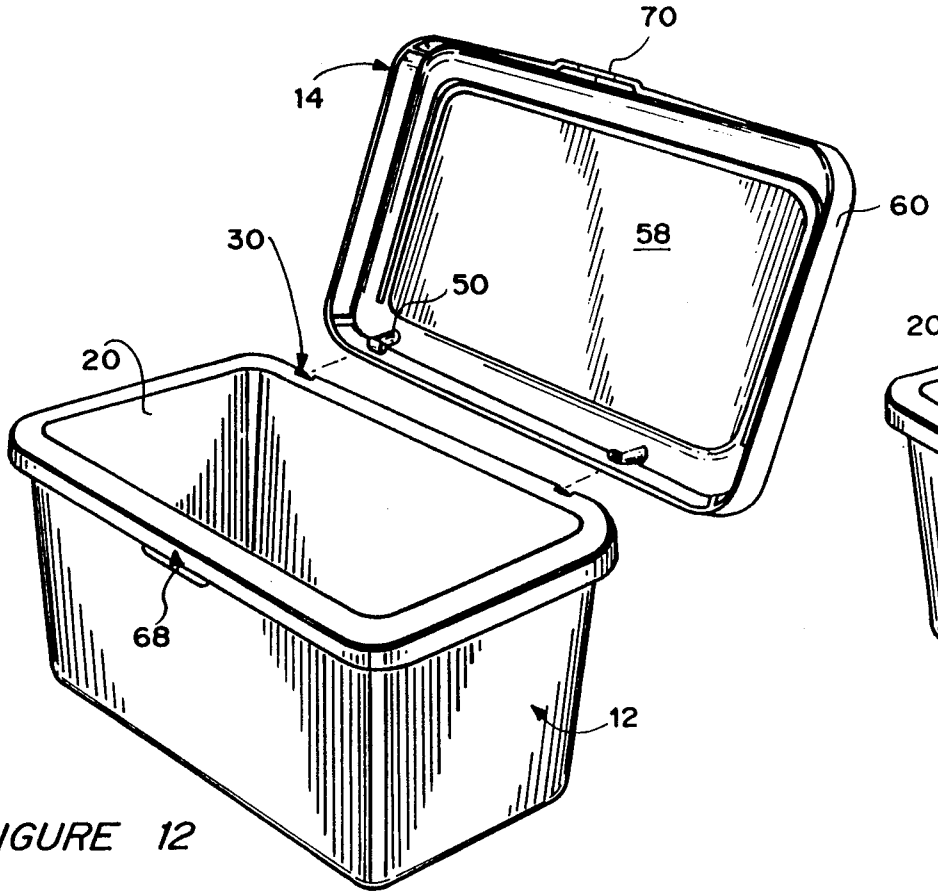
FIG. 12 is a perspective, exploded view showing the container cover detached from the container body.

FIGS. 13 and 14 illustrate an alternative embodiment of a container constructed in accordance with the teachings of the present invention. The only difference between the container 10A shown in FIGS. 13 and 14 and container 10 is the incorporation in container 10A of a drip panel 80 which is preferably integrally formed with and projects from top cover panel 58A. Drip panel 80 has a distal end which extends over interior 20A when cover 14A is in its fully opened position, as illustrated in FIGS. 13 and 14. When the cover 14A is in such position the drip panel 80 will have a downward tilt in the direction of the container interior 20A.

The drip panel is useful when container 10A is utilized to store moist articles such as pre-moistened wipes or the like since it has been found that storage of moist products of this type occasionally result in the formation of condensation on the inside of the top cover panel. In the absence of drip panel 80 such condensation would be spilled outside the container; however, with the drip panel 80 such moisture will be redirected back to the product located within interior 20A. When the cover 14A is closed the drip panel will be housed within interior 20A.

We claim:

1. A container comprising, in combination:

a container body including a plurality of interconnected side walls and a bottom wall, said container body walls defining an interior;

at least one socket member connected to said container body, said socket member including spaced, generally opposed first and second socket walls defining a passageway having a wider end and a narrower end with an opening proximate to said wider end, said first socket wall defining a receptable residing proximate to said narrower end and said second socket wall defining a contract surface; and a cover attachable to said container body, said cover including a top cover panel and at least one pivot member operatively associated with said top cover panel, said pivot member including a support arm and a projection projecting from said support arm, said support arm being engageable with said contact surface and said projection being positionable in said receptacle when said support arm is in the passageway and located between said first and second socket walls said support arm extending through said wider end of said passageway and into said narrower end when said cover is in a closed position on said container body.

2. A container according to claim 1 wherein said container body includes a lip element extending outwardly from at least one of said container body side walls, said socket member integrally formed with said lip element and positioned adjacent to and external of a container body side wall.

3. The container according to claim 2 wherein said lip element includes an outwardly extending lip segment and a downwardly extending lip segment integrally attached to said outwardly extending lip segment, said spaced, generally opposed socket walls extending from and being integral with said lip element and said passageway in communication with and leading from an opening formed in said lip element.

4. The container according to claim 3 wherein said spaced, generally opposed socket walls converge whereby said passageway narrows as it progresses from said opening.

5. The container according to claim 1 wherein the second socket wall contact surface continually bears against the support arm of a pivot member after the projection of said pivot member is positioned in said receptacle whereby said projection is locked in said receptacle.

6. The container according to claim 4 wherein at least one of said spaced, generally opposed socket walls is deformable and moveable relative to the other of said spaced, generally opposed socket walls when a predetermined force is exerted against said deformable socket wall by a pivot member.

7. The container according to claim 3 wherein a slit is formed in said downwardly extending lip segment, said slit being in communication with said passageway.

8. The container according to claim 3 wherein said receptacle comprises an aperture, said first socket wall including a slanted guide surface leading from said opening toward said aperture.

9. The container according to claim 2 wherein said cover additionally includes a peripheral skirt extending about said top cover panel for placement adjacent to and external of said container body lip element when said cover is disposed over said interior, said at least one pivot member being attached to said top cover panel at a location spaced inwardly of said peripheral skirt.

10. The container according to claim 9 wherein said peripheral skirt engages said container body after said cover is moved from a closed position whereat said interior is closed to an open position whereat said interior is open, said peripheral skirt cooperable with said container body and said at least one socket member to maintain said cover in said open position.

11. The container according to claim 10 wherein said cover additionally includes a drip panel projecting from said top cover panel and extending substantially the length of said top cover panel, said drip panel having a distal end projecting over said interior when said cover is in said open position whereby liquid flowing on said tray cover panel will be directed into said interior.

12. The container according to claim 1 wherein said first socket wall is formed of frangible material.

13. In combination:

a container body including a plurality of interconnected side walls and a bottom wall, said container body walls defining an interior, and a lip element attached to said side walls and peripherally disposed about said interior, said lip element including an outwardly extending lip segment and a downwardly extending lip segment, said outwardly extending lip segment defining at least one opening therein; and first and second socket walls attached to said lip element and defining a passageway leading from said opening for receiving a cover pivot member introduced through said opening, said first socket wall defining a receptacle and said second socket wall defining a contact surface for engaging said cover pivot member and urging said pivot member toward said receptacle, said first and second socket walls converging toward one another whereby said passageway narrows as it progresses from said opening.

14. The combination according to claim 13 wherein at least one of said socket walls is deformable and moveable relative to the other of said socket walls when a predetermined force is exerted against said deformable socket wall.

15. The combination according to claim 13 wherein said downwardly extending lip wall segment defines a slit in communication with said passageway.

16. A container comprising:

a container body including a plurality of interconnected side walls and a bottom wall, said container body walls defined an interior;

at least one socket member connected to said container body, said socket member including spaced, generally opposed first and second socket walls defining a passageway open at an upper end thereof, said passageway being more narrow at a lower end thereof than at said upper end, said first socket wall defining a receptacle and said second socket wall defining a contact surface; and a cover attachable to said container body, said cover having at least one pivot member protruding therefrom, and a cover panel, said upper end being most proximate to said cover panel, said pivot member including a support arm and a projection extending from said support arm, wherein said contact surface engages said support arm and urges said projection toward said receptacle.

17. A container as recited in claim 16 wherein:

at least one of said spaced, generally opposed socket walls is deformable and moveable relative to the other said spaced, generally opposed socket walls when a predetermined force is exerted against said deformable socket wall by a pivot member.

18. A container as recited in claim 16 wherein:

said container body includes a lip element including a first lip segment extending outwardly from at least one of said container body side walls, and a second lip segment extending downwardly from said first lip segment; and a slit formed in said second lip segment, said slit being in communication with said passageway.

* * * * *